US010704241B2

(12) United States Patent
Miller

(10) Patent No.: US 10,704,241 B2
(45) Date of Patent: Jul. 7, 2020

(54) SINK

(71) Applicant: Top Shelf Manufacturing, Inc., Warren, OH (US)

(72) Inventor: Samuel M. Miller, Warren, OH (US)

(73) Assignee: Top Shelf Manufacturing, Inc., Warren, OH (US)

( * ) Notice: Subject to any disclaimer, the term of this patent is extended or adjusted under 35 U.S.C. 154(b) by 0 days.

(21) Appl. No.: 16/144,339

(22) Filed: Sep. 27, 2018

(65) Prior Publication Data

US 2020/0102726 A1 Apr. 2, 2020

(51) Int. Cl.
*E03C 1/33* (2006.01)
*E03C 1/18* (2006.01)

(52) U.S. Cl.
CPC . *E03C 1/18* (2013.01); *E03C 1/33* (2013.01)

(58) Field of Classification Search
CPC ..... E03C 1/18; E03C 1/33
USPC ..... 4/628
See application file for complete search history.

(56) References Cited

U.S. PATENT DOCUMENTS

| | | | | |
|---|---|---|---|---|
| D663,389 | S | 7/2012 | Miller et al. | |
| D670,367 | S | 11/2012 | Miller et al. | |
| D675,300 | S | 1/2013 | Miller et al. | |
| 9,066,631 | B2 * | 6/2015 | Didehvar | A47K 1/02 |
| 9,173,487 | B2 * | 11/2015 | Booth | E03C 1/18 |

* cited by examiner

*Primary Examiner* — Lauren A Crane
(74) *Attorney, Agent, or Firm* — Fox Rothschild LLP

(57) ABSTRACT

A sink with an integrally formed an inconspicuous storage space including a storage shelf. The sink has a basin portion and a niche that is integrally formed into the basin and extends substantially along the basin widthwise. The niche is an open area surrounded by three walls including a substantially horizontal floor that forms a substantially horizontal shelf, a substantially vertical wall, and a substantially horizontal ceiling disposed above the floor. The shelf may be used to store dishwashing accessories such as sponges and pads, and other items. The niche is aesthetically pleasing because it is not viewable from the front of the sink and can be seen only from the interior of the sink.

9 Claims, 8 Drawing Sheets

SINK

The present invention is directed towards a sink and, more particularly, towards a sink with an integrated storage shelf.

Traditional under-mount and top-mount sinks, including designs such as farmhouse sinks, have a downside in that there is no readily accessible area for storing dishwashing accessories, such as dishcloths and sponges. Thus, there is a need in the art for an improved sink that provides integrated, yet aesthetically pleasing, storage space.

BRIEF SUMMARY

In view of the foregoing background, example implementations of the present disclosure include a sink, such as a traditional sink or a farmhouse sink, having a niche integrally formed into the basin of the sink. The niche is open and is defined by a substantially horizontal floor that serves as a substantially horizontal shelf, a substantially vertical wall, and a substantially horizontal ceiling disposed above the floor. The sink is not visible from a front view of the sink. In the example of a traditional under-mount or top-mount sink, the niche extends outwardly from the basin. In the example of a farmhouse sink, a cavity is disposed between the basin and the apron. The niche is disposed within the cavity and is integrally formed into the basin such that it extends substantially widthwise along the basin.

In yet a further implementation of the present disclosure, a method of manufacturing a sink is provided, including the step of manufacturing a sink with a basin and an integrated niche. In the example of a farmhouse sink, a front-facing apron is integrally connected to the basin, a cavity is disposed between the basin and the apron, and the niche is disposed within the cavity that is integrally formed into the basin. The niche is defined by a substantially horizontal floor that serves as a substantially horizontal shelf, a substantially vertical wall, and a substantially horizontal ceiling disposed above the floor.

DETAILED DESCRIPTION OF THE PRESENT INVENTION

The present invention is directed towards a sink with an integrated and aesthetically pleasing storage area.

Figure 1:
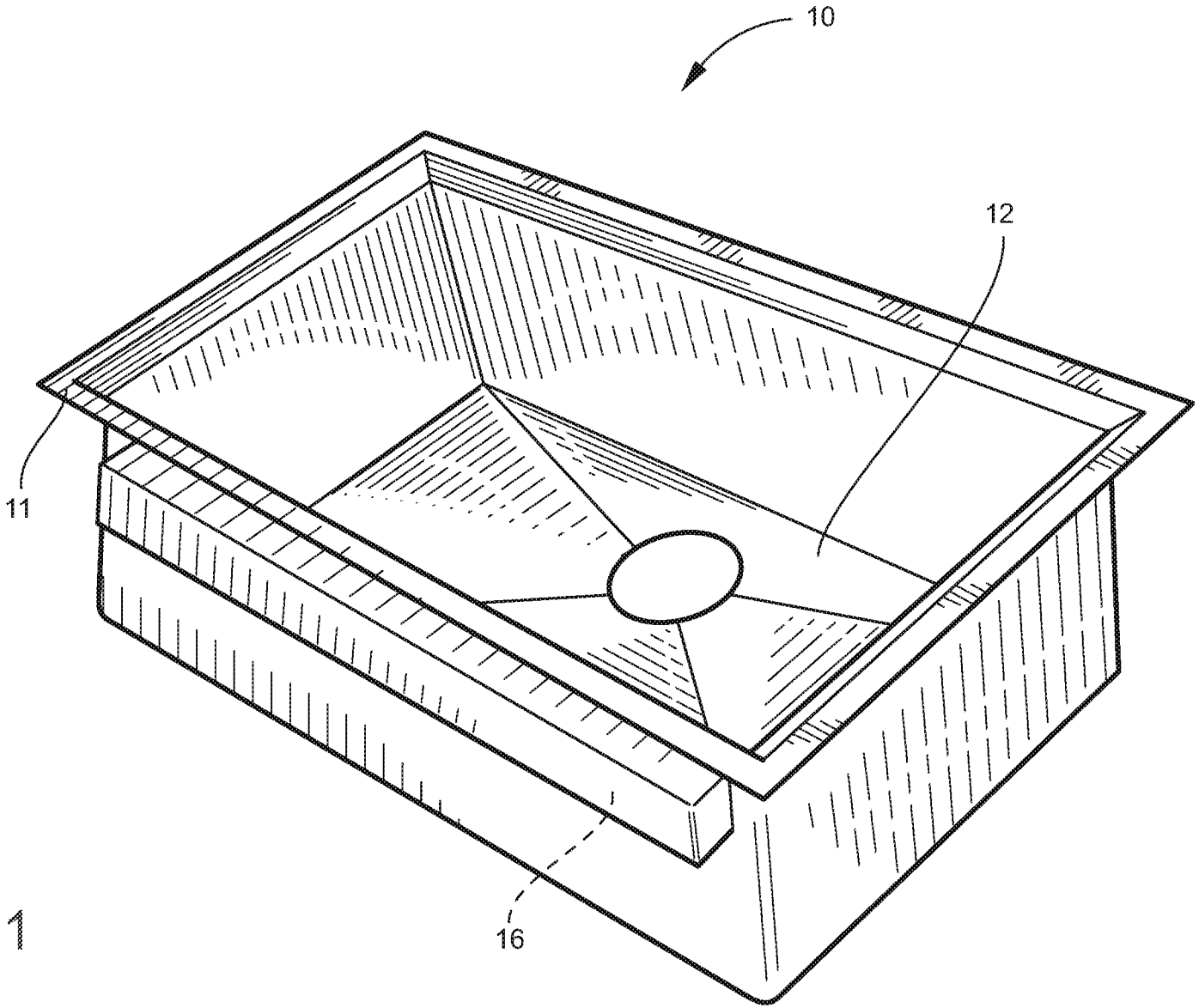
FIG. 1 is a front perspective view of a sink with a storage shelf.
Figure 2:
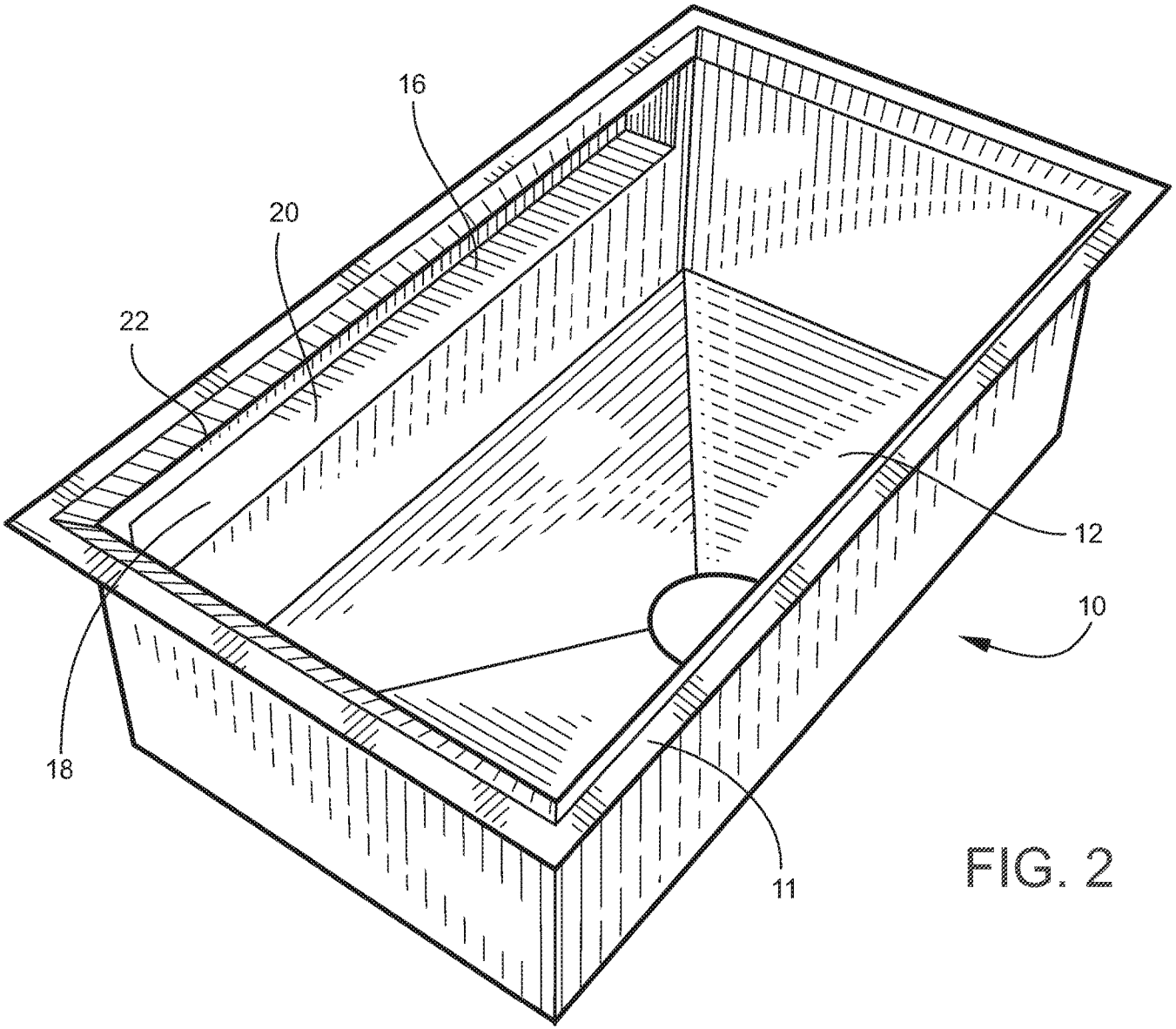
FIG. 2 is a rear perspective view of the sink in FIG. 1.
Figure 3:
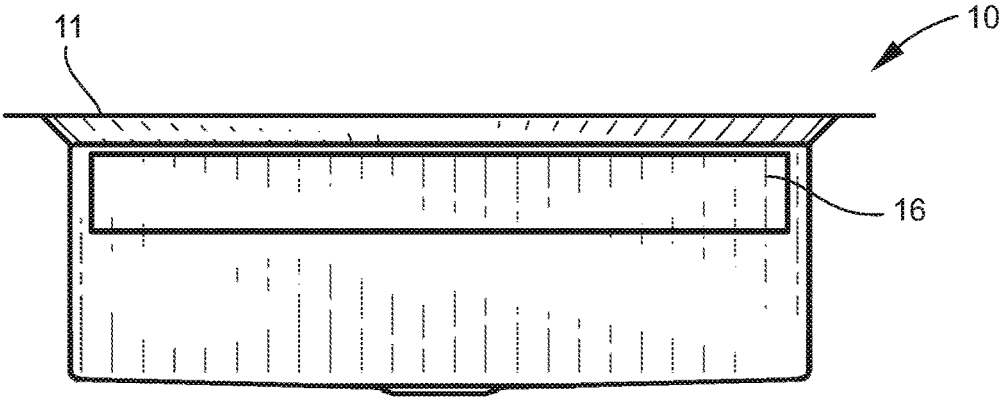
FIG. 3 is a front elevation view of the sink in FIG. 1.
Figure 4:
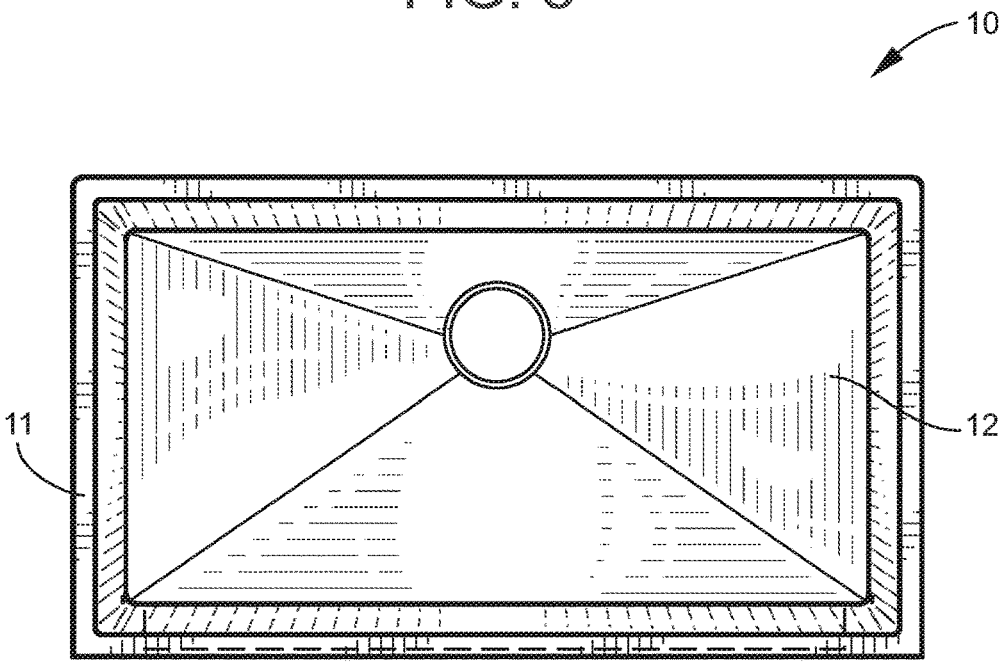
FIG. 4 is a top elevation view of the sink in FIG. 1.
Figure 5:
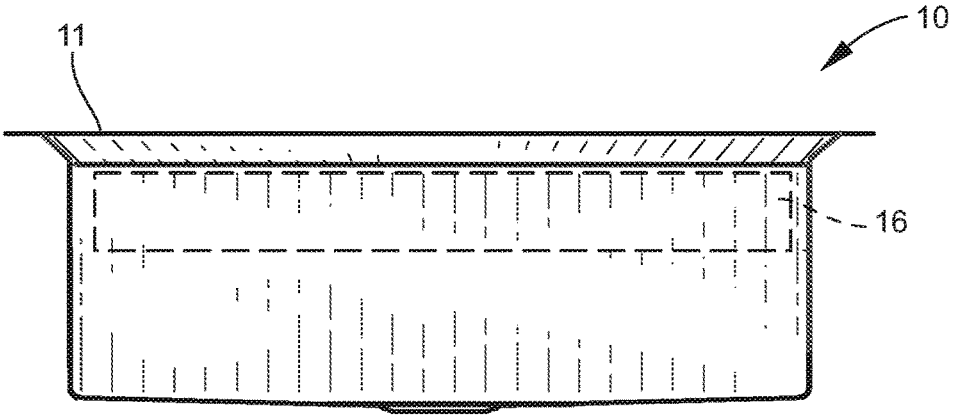
FIG. 5 is a rear elevation view of the sink in FIG. 1.
Figure 7:
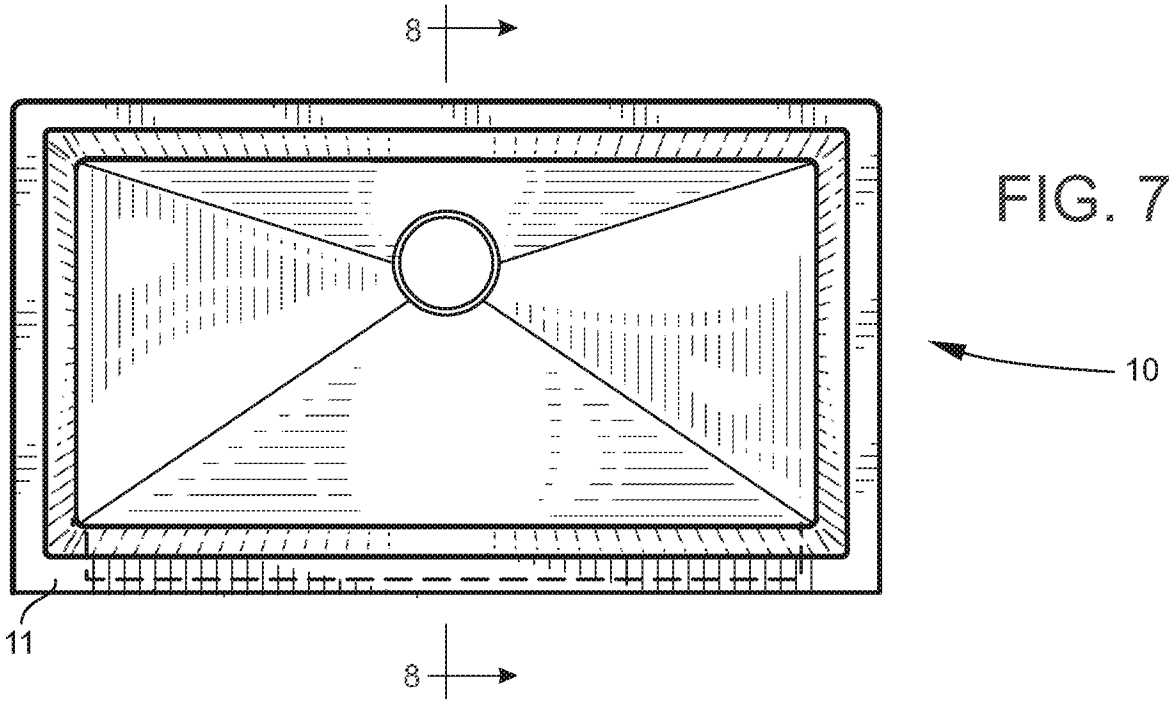
FIG. 7 is bottom elevation view of the sink in FIG. 1.
Figure 8:
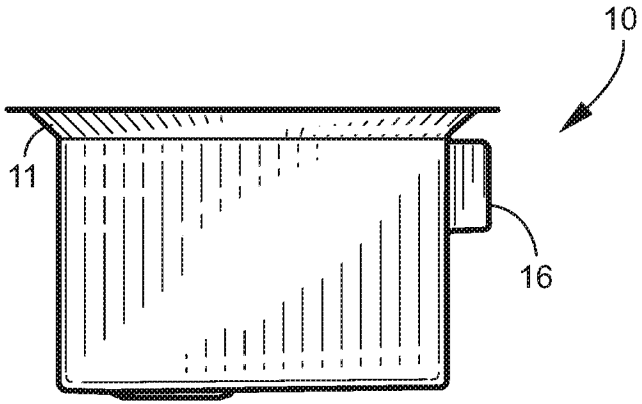
FIG. 8 is a left side elevation view of the sink in FIG. 1.
Figure 6:
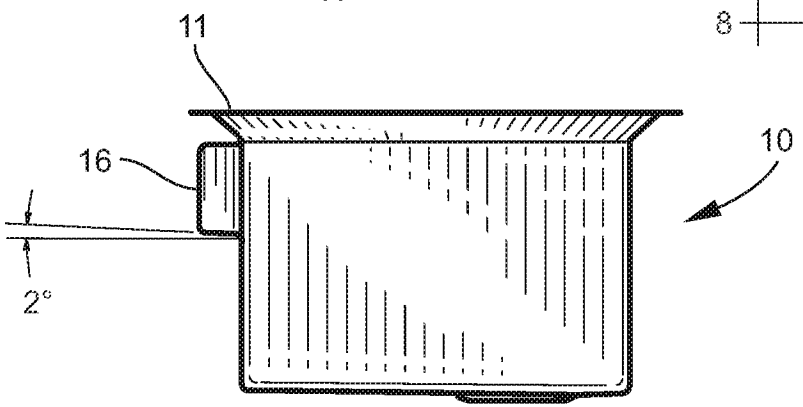
FIG. 6 is a right side elevation view of the sink in FIG. 1.

According to a first implementation of the present disclosure, as shown in FIGS. 1-8, a traditional top-mount sink 10 with a basin 12 is provided. However, the present disclosure is not limited to a top-mount sink and may be utilized in connection with a traditional under-mount sink or a farmhouse sink, as explained further below. The sink 10 may be manufactured of known, durable materials such as porcelain or stainless steel. The sink 10 is designed to have a lip 11 that may be secured to the cabinet or countertop within which the sink 10 fits. The sink 10 additionally includes an integrated storage niche 16, which extends outwardly from the basin 12. The niche 16 is not visible from the front of the sink 10 and, rather, is only visible by looking downward into the sink 10 or from the rear of the sink 10. The open niche 16 is integrally formed into the front-interior of the basin 12 and is defined by three walls including a substantially horizontal planar surface as the floor which serves as a shelf 18, a substantially vertical wall 20, and a substantially horizontal ceiling 22.

Figure 9:
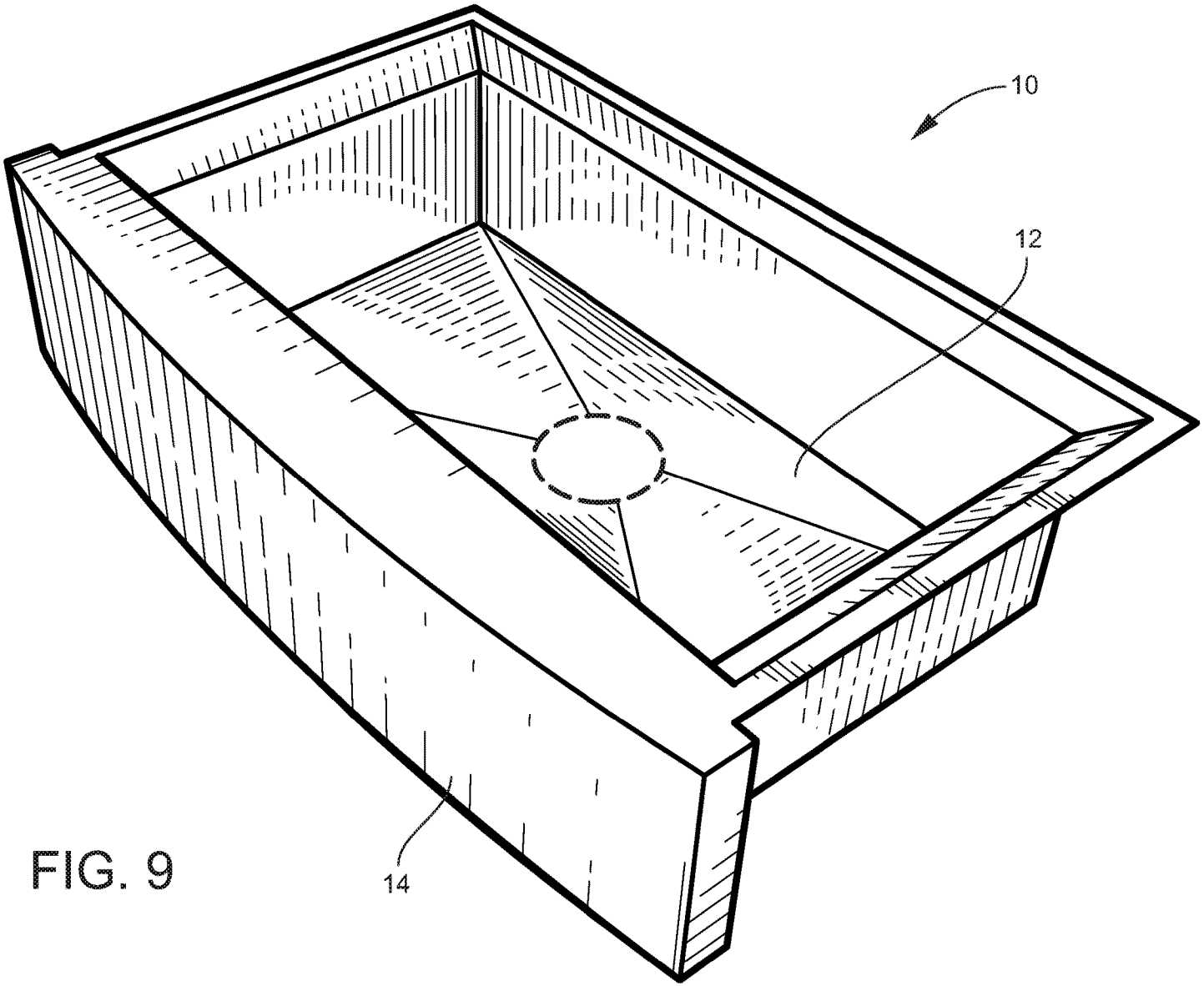
FIG. 9 is a front perspective view of a farmhouse sink with a storage shelf.
Figure 10:
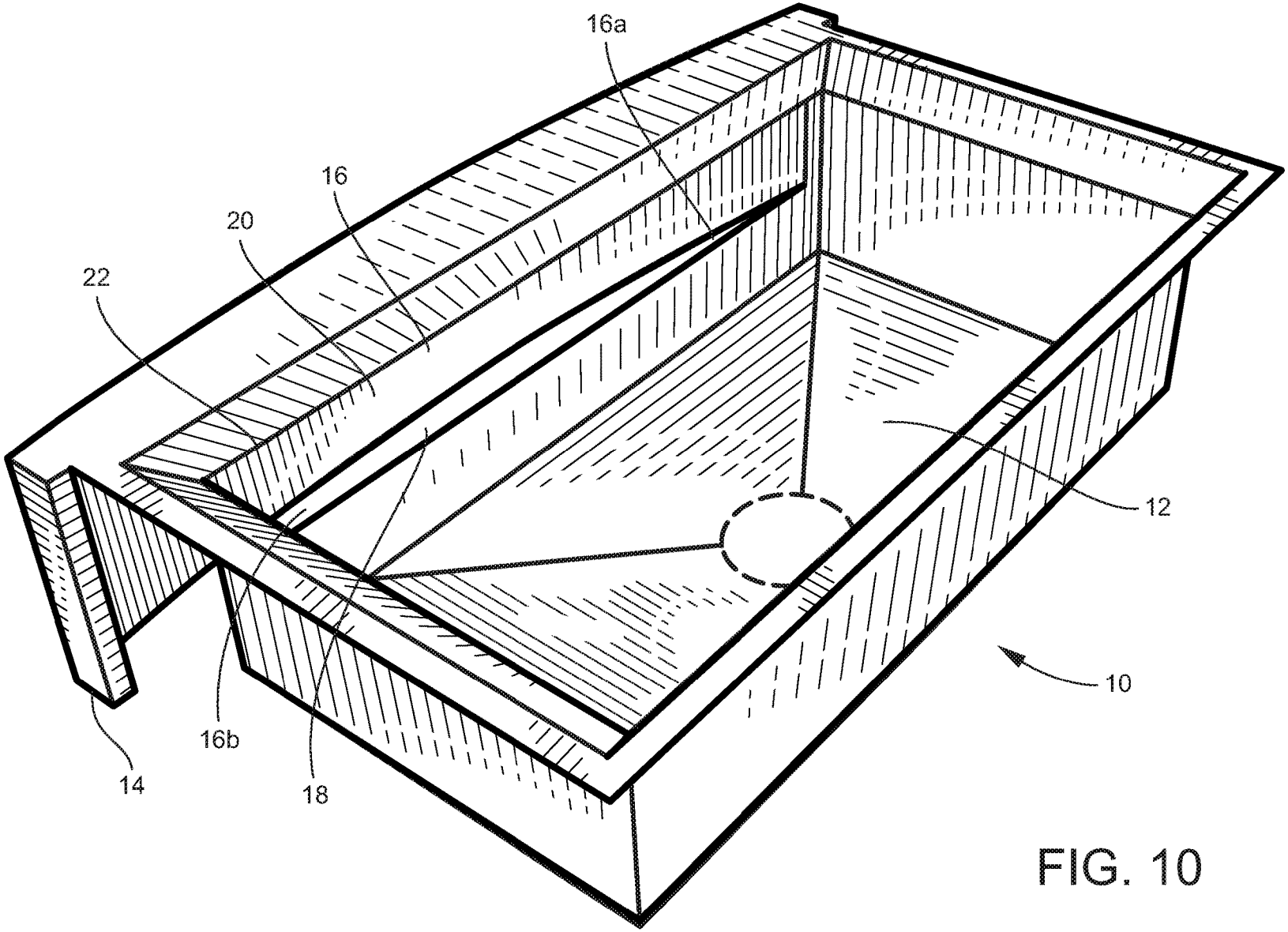
FIG. 10 is a rear perspective view of the farmhouse sink in FIG. 9.
Figure 11:
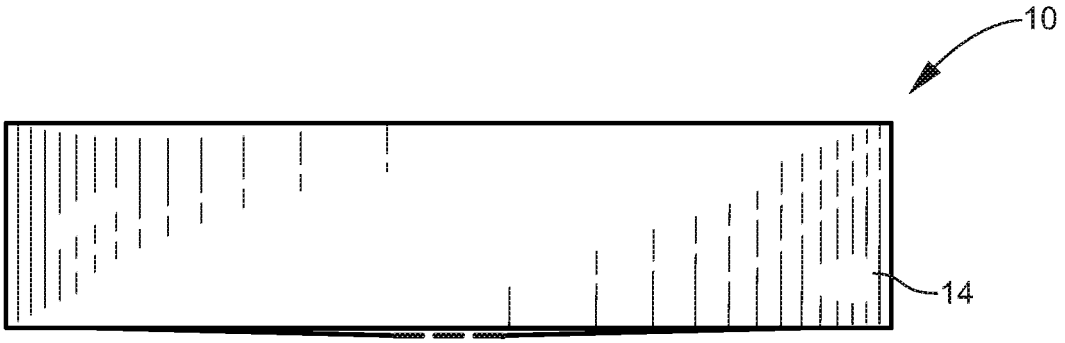
FIG. 11 is a front elevation view of the farmhouse sink in FIG. 9.
Figure 12:
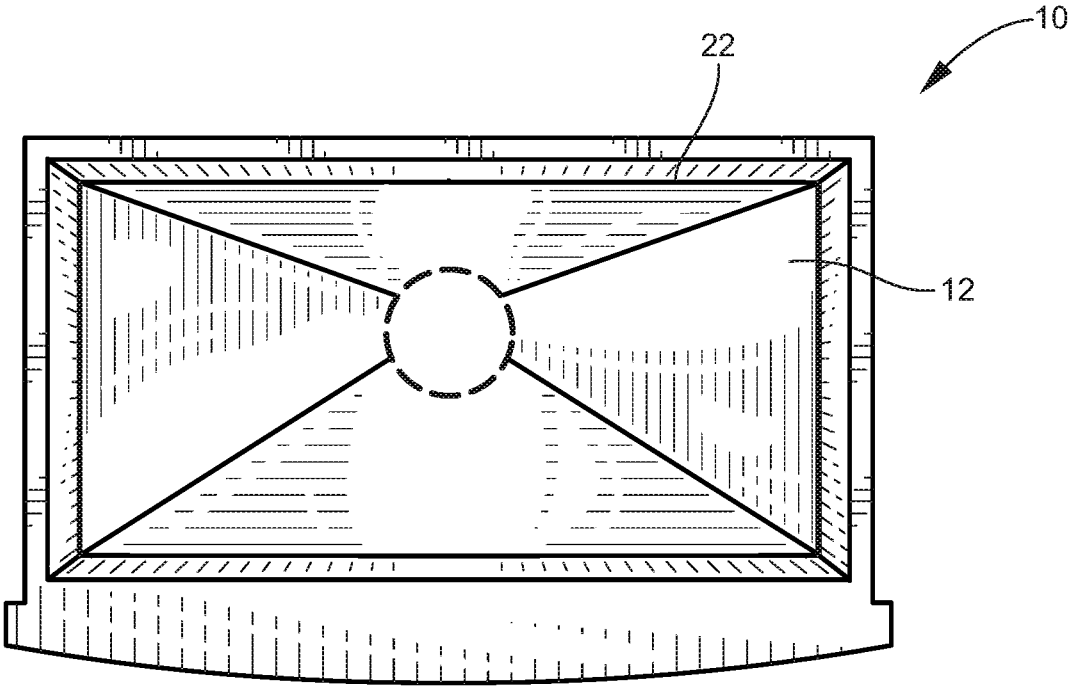
FIG. 12 is a top elevation view of the farmhouse sink in FIG. 9.
Figure 13:
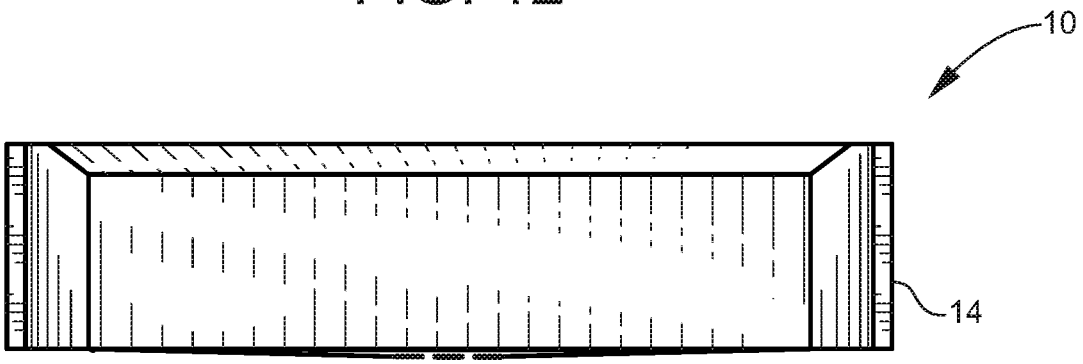
FIG. 13 is a rear elevation view of the farmhouse sink in FIG. 9.
Figure 16:
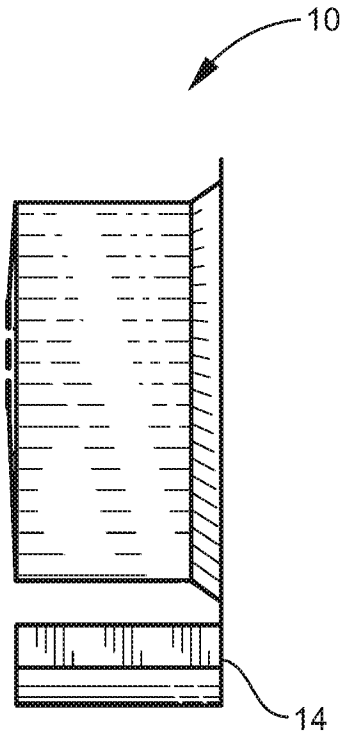
FIG. 16 is a left side elevation view of the farmhouse sink in FIG. 9.
Figure 15:
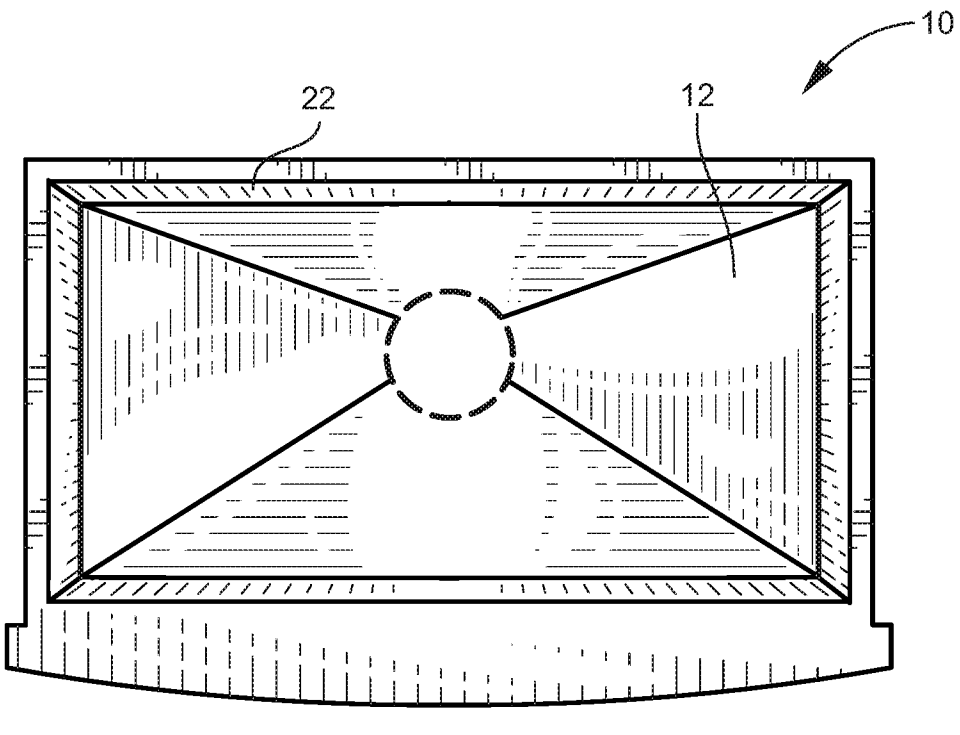
FIG. 15 is bottom elevation view of the farmhouse sink in FIG. 9.
Figure 14:
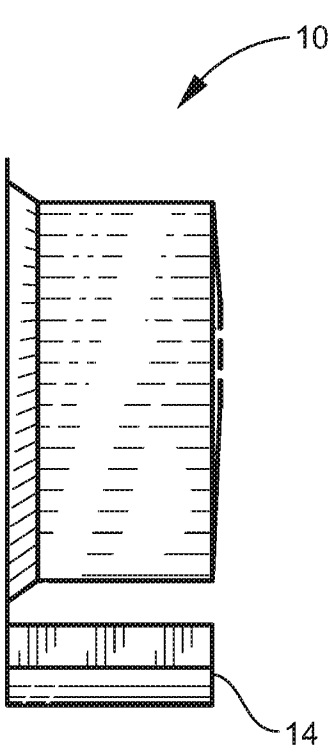
FIG. 14 is a right side elevation view of the farmhouse sink in FIG. 9.

In yet a second implementation of the present disclosure, as shown in FIGS. 9-16, a farmhouse sink 10 with a basin 12 and front-facing apron 14 is provided. As noted above, the sink may be manufactured of known, durable materials such as porcelain or stainless steel. Given the design of the front-facing apron 14, a cavity exists between the apron 14 and the basin 12 portions of the sink 10 wherein an integrated storage niche 16 is disposed. The niche 16 is not visible from the front of the sink 10 and, rather, is only visible by looking downward into the sink 10 or from the rear of the sink 10. The open niche 16 is integrally formed into the front-interior of the basin 12 and is defined by three walls including a substantially horizontal planar surface as the floor which serves as a shelf 18, a substantially vertical wall 20, and a substantially horizontal ceiling 22.

In one variation of this implementation of the present disclosure, the front facing surface of the apron 14 is bowed so that it has a greater depth in the center of the apron 14 than on the left and right ends of the apron 14, when viewed from the top of the sink 10. Given the bowed front surface of the apron 14, the vertical wall 20 of niche 16 mimics such shape and is likewise bowed such that the niche 16 has a greater depth in center of the niche 16 than on the respective ends 16*a*, 16*b* of the niche 16.

The present disclosure of the farmhouse sink is not limited to the apron 14 having a bowed surface as shown in the Figures. Rather, the apron 14 may have a more traditional, flat panel surface, which still creates a cavity in which the niche 16 can be disposed. In this example implementation of the present disclosure, the substantially vertical wall 20 has also has a flat surface and the niche 16 has substantially the same depth from end 16*a* to end 16*b*.

The foregoing-described sink having an integrated storage niche is a functional improvement over prior art sinks and is also aesthetically pleasing. Sink accessories such as sponges, small dishcloths, and scrubbing pads can easily be stored on the shelf so the user does not have to reach for them in cabinets or other inconvenient locations. Additionally, the disposition of the niche within the front interior of the sink makes the location generally inconspicuous so such dishwashing accessories are not in plain view.

While certain embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

What is claimed is:

1. A sink comprising:

a basin;

a niche integrally formed into the basin that extends substantially widthwise along the basin;

wherein the niche is defined by a substantially horizontal floor that forms a substantially horizontal shelf, a substantially vertical wall, and a substantially horizontal ceiling disposed above the floor; and wherein the substantially horizontal ceiling overhangs an entirety of the substantially horizontal floor such that the substantially horizontal ceiling and substantially horizontal floor extend to points in a substantially same vertical plane.

2. The sink of claim 1 further comprising:

a front-facing apron that is integrally connected to the basin; and a cavity that is disposed between the basin and the apron; wherein the niche disposed within the cavity.

3. The sink of claim 2 wherein, as viewed from the top of the sink, a front surface of the apron is outwardly bowed away from the basin such that a depth of the apron is greatest in the center of the apron and decreasingly tapers towards each end of the apron.

4. The sink of claim 3 wherein, as viewed from the top of the sink, the vertical wall of the niche is outwardly bowed away from the basin such that a depth of the niche is greatest in the center of the niche and decreasingly tapers towards each end of the niche.

5. The sink of claim 2 wherein, as viewed from the top of the sink, a front surface of the apron is substantially flat such that a depth of the apron is substantially the same in the center of the apron and on each end of the apron.

6. The sink of claim 1 wherein the niche extends outward from the basin such that the substantially vertical wall is exterior to the basin.

7. The sink of claim 1 wherein the niche is not visible from a front view of the sink.

8. The sink of claim 1 wherein, as viewed from the top of the sink, the vertical wall has a substantially flat surface such that a depth of the niche is substantially the same in the center of the niche and on each end of the niche.

9. The sink of claim 1 wherein the substantially horizontal floor of the niche supports a dishwashing accessory resting directly on such substantially horizontal floor, the dishwashing accessory being selected from the group consisting of a sponge, dishcloth or dishwashing pad.

* * * * *